United States Patent [19]

Swenson

[11] Patent Number: 4,997,110

[45] Date of Patent: Mar. 5, 1991

[54] CONCEALABLE WATER SHOOTER

[76] Inventor: Andrew J. Swenson, 10 Seafield La., Bay Shore, N.Y. 11706

[21] Appl. No.: 467,014

[22] Filed: Jan. 18, 1990

[51] Int. Cl.[5] ..... B67B 3/00

[52] U.S. Cl. ..... 222/175

[58] Field of Search ..... 222/175, 178; 224/148, 224/222, 267, 901; 239/152, 153, 154; 272/27 N, 27 R, 27 W; 446/26, 267

[56] References Cited

U.S. PATENT DOCUMENTS

| | | | |
|---|---|---|---|
| 1,885,180 | 11/1932 | Cameron | 222/175 |
| 4,037,790 | 7/1977 | Reiser et al. | 222/175 |
| 4,768,681 | 9/1988 | Dean et al. | 222/175 |
| 4,903,864 | 2/1990 | Sirhan | 222/175 |

*Primary Examiner*—Andres Kashnikow
*Assistant Examiner*—Philippe Derakshani
*Attorney, Agent, or Firm*—Michael I. Kroll

[57] ABSTRACT

A concealable water shooter is provided and consists of a sealable reservoir for holding water therein removably attached to an upper arm of a person. A housing is carried on a forearm and into a palm of a hand of the person so that it can be hidden from view when covered by a sleeve of a garment worn by the person. A pump in the housing is fluidly connected between the reservoir and a nozzle in the housing. An electronic system in the housing, controllable by a finger of the person, electrically operates the pump so that some of the water will exit through the nozzle and can spray onto another unsuspecting person.

7 Claims, 1 Drawing Sheet

CONCEALABLE WATER SHOOTER

BACKGROUND OF THE INVENTION

1. Field of the Invention

The instant invention relates generally to water guns and more specifically it relates to a concealable water shooter.

2. Description of the Prior Art

Numerous water guns have been provided in prior art that are adapted to be visibly held in the hand to shoot water therefrom. While these units may be suitable for the particular purpose to which they address, they would not be as suitable for the purposes of the present invention as heretofore described.

SUMMARY OF THE INVENTION

A primary object of the present invention is to provide a concealable water shooter that will overcome the shortcomings of the prior art devices.

Another object is to provide a concealable water shooter that is worn on the arm of a person under a sleeve of a garment so that the person can spray water on another unsuspecting person.

An additional object is to provide a concealable water shooter that includes a hydraulic system that is activated by an electronic pump which is controlled by a finger switch.

A further object is to provide a concealable water shooter that is simple and easy to use.

A still further object is to provide a concealable water shooter that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
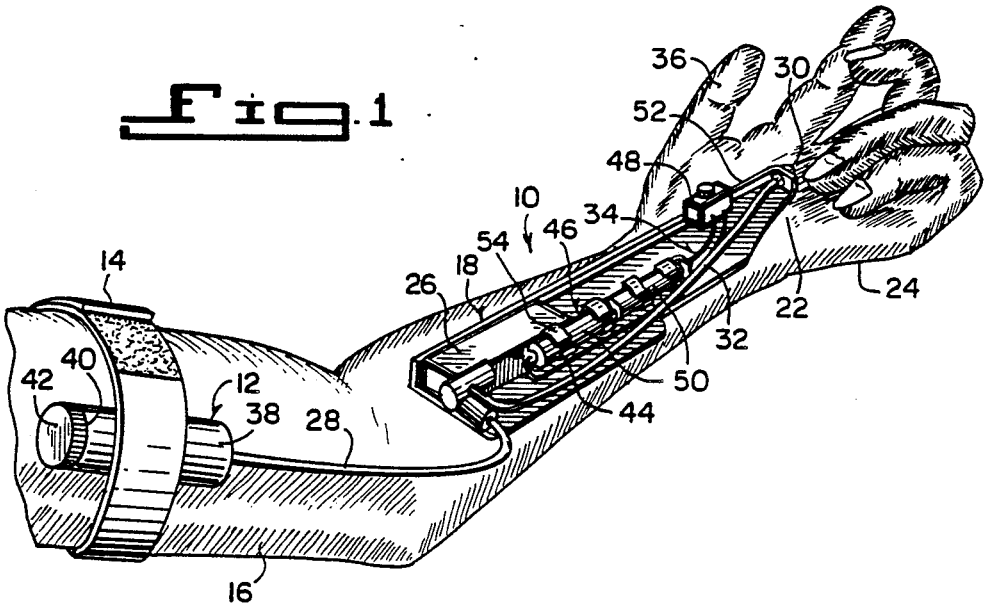
FIG. 1 is a perspective view of the invention worn on an arm of a person.
Figure 2:
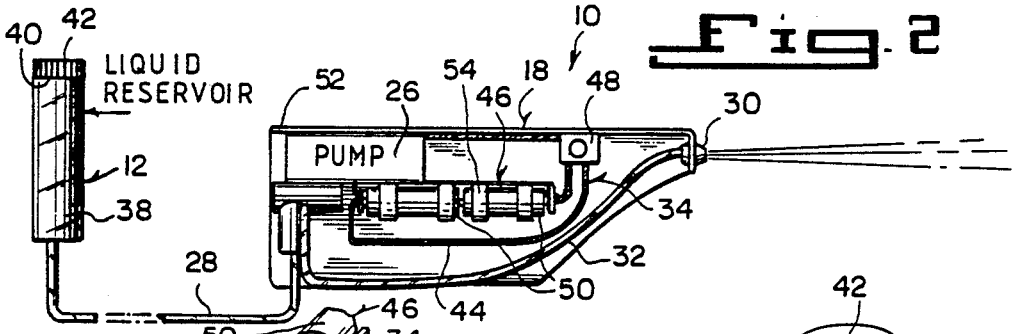
FIG. 2 is a top view thereof.
Figure 3:
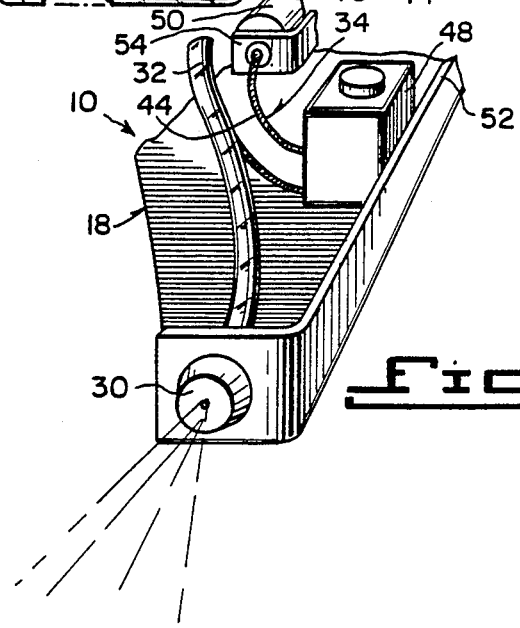
FIG. 3 is a front perspective view with parts broken away showing the nozzle in greater detail.
Figure 4:
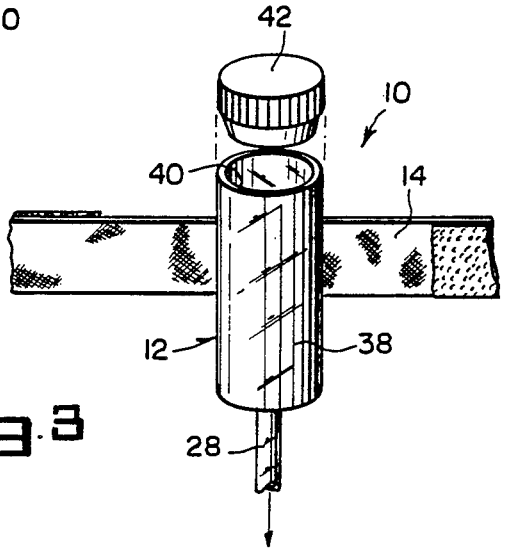
FIG. 4 is a perspective view of the reservoir showing the cap removed from the container and the VELCRO strap open with parts broken away.

Turning now descriptively to the drawings, in which similar reference characters denote similar elements throughout the several views, FIGS. 1 through 4 illustrates a concealable water shooter 10 consisting of a sealable reservoir 12 for holding water therein. A VELCRO strap 14 is for removably attaching the reservoir 12 to the inside of an upper arm 16 of a person. A housing 18 is carried on the inside or a forearm 20 and into a palm 22 of a hand 24 of the person. The housing 18 can be hidden from view when covered by a sleeve of a garment (not shown) worn by the person. A pump 26 in the housing 18 is fluidly connected to the reservoir 12 by a first flexible tube 28. A nozzle 30 in the housing 18 is fluidly connected to the pump 26 by a second flexible tube 32. An electronic system 34 is provided in the housing 18 and is controllable by a finger 36, such as the thumb, of the person for electrically operating the pump 26, so that some of the water from the reservoir 12 will exit through the nozzle 30 and can spray onto another unsuspecting person.

The reservoir 12 includes a container 38 having an open top 40 for placing the water therein. A cap 42 is removably attached onto the open top 40 for sealing the container 38 while the VELCRO strap 14 wraps around the container 38 and the upper arm 16 of the person.

The electronic system 34 includes an electric circuit 44 connected to the pump 26 and is carried in the housing 18. A power source 46 is in the electric circuit 44 for supplying electricity to operate the pump 26. A switch 48 in the electric circuit 44, operable by the finger 36 of the person, is for turning the pump 26 on and off. The power source 46 is at least one battery 50, while the housing 18 has an open top 52 so that access can be made therein. A holder 54 is provided in the housing 18 and is electrically connected into the electric circuit 44 and will removably grip the battery 50 so that the battery can be replaced when needed.

To use the concealable water shooter 10 a person will remove the cap 42 and place water into the container 38. The cap 42 is then replaced and the container 38 removably attached on the inside of the upper arm 16 so that the housing 18 will be carried on the forearm 20. The garment such as a shirt or the like is then worn by the person to hide the water shooter 10. When the person presses the switch 48 with a finger 36 the water will spray onto another unsuspecting person.

LIST OF REFERENCE NUMBERS

10 concealable water shooter
12 sealable reservoir
14 VELCRO strap
16 upper arm
18 housing
20 forearm
22 palm
24 hand
26 pump
28 first flexible tube
30 nozzle
32 second flexible tube
34 electronic system
36 finger (thumb)
38 container
40 open top in 38
42 cap
44 electric circuit
46 power source
48 switch
50 battery
52 open top in 18
54 holding clamp It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A concealable water shooter comprising:

(a) a sealable reservoir for holding water therein;

(b) means for removably attaching said reservoir to the inside of an upper arm of a person;

(c) a housing carried on the forearm and into a palm of a hand of a person so that said housing can be hidden from view when covered by a sleeve of a garment worn by the person;

(d) a pump in said housing fluidly connected to a nozzle; and (e) means in said housing controllable by a finger of a person for electrically operating said pump so that some of the water from said reservoir will exit through said nozzle and can spray onto another unsuspecting person.

2. A concealable water shooter as recited in claim 1, wherein said reservoir includes:

(a) a container having an open top for placing the water therein; and (b) a cap removably attached onto the open top for sealing said container.

3. A concealable water shooter as recited in claim 2, wherein said removably attaching means is a VELCRO strap which wraps around said container and the upper arm of the person.

4. A concealable water shooter as recited in claim 3, wherein said electrically operating means includes:

(a) an electric circuit connected to said pump and carried in said housing;

(b) a power source in said electric circuit for supplying electricity to operate said pump; and (c) a switch in said electric circuit operable by the finger of the person for turning said pump on and off.

5. A concealable water shooter as recited in claim 4, wherein said power source is at least one battery.

6. A concealable water shooter as recited in claim 5, further including said housing having an open top so that access can be made therein.

7. A concealable water shooter as recited in claim 6, further including a holding clamp, said housing electrically connected into said electric circuit and will removably grip said at least one battery so that said at least one battery can be replaced when needed.

* * * * *